US012098347B2

(12) United States Patent
Hoshino et al.

(10) Patent No.: US 12,098,347 B2
(45) Date of Patent: Sep. 24, 2024

(54) LUBRICATING COMPOSITION FOR FUEL EFFICIENT MOTORCYCLE APPLICATIONS

(71) Applicant: Afton Chemical Corporation, Richmond, VA (US)

(72) Inventors: Hidetaka Hoshino, Yokohama (JP); Akiyuki Honda, Richmond, VA (US); Guillaume Carpentier, Bracknell (GB)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/933,914

(22) Filed: Sep. 21, 2022

(65) Prior Publication Data

US 2024/0110123 A1 Apr. 4, 2024

(51) Int. Cl.

| | |
|---|---|
| ***C10M 169/04*** | (2006.01) |
| ***C10M 135/18*** | (2006.01) |
| ***C10M 145/14*** | (2006.01) |
| ***C10M 161/00*** | (2006.01) |
| *C10N 20/04* | (2006.01) |
| *C10N 30/00* | (2006.01) |
| *C10N 30/02* | (2006.01) |
| *C10N 40/04* | (2006.01) |
| *C10N 40/26* | (2006.01) |

(52) U.S. Cl.

CPC ..... *C10M 169/044* (2013.01); *C10M 135/18* (2013.01); *C10M 145/14* (2013.01); *C10M 161/00* (2013.01); *C10M 2203/003* (2013.01); *C10M 2209/084* (2013.01); *C10M 2219/068* (2013.01); *C10N 2020/04* (2013.01); *C10N 2030/02* (2013.01); *C10N 2030/54* (2020.05); *C10N 2040/04* (2013.01); *C10N 2040/26* (2013.01)

(58) Field of Classification Search

CPC ..... C10M 135/18; C10M 145/14; C10M 161/00; C10M 169/044; C10M 2203/003; C10M 2209/084; C10M 2219/068

See application file for complete search history.

(56) References Cited

U.S. PATENT DOCUMENTS

| | | | |
|---|---|---|---|
| 4,859,352 | A | 8/1989 | Waynick |
| 6,586,374 | B1 | 7/2003 | Paul |
| 6,667,281 | B2 | 12/2003 | Ikejima et al. |
| 6,903,056 | B2 | 6/2005 | Nagano et al. |
| 8,143,202 | B2 | 3/2012 | Peer et al. |
| 8,400,030 | B1 | 3/2013 | Tang et al. |
| 8,563,486 | B2 | 10/2013 | Tsujimoto et al. |
| 8,664,169 | B2 | 3/2014 | Bouffet |
| 8,901,052 | B2 | 12/2014 | Sagawa et al. |
| 8,999,904 | B2 | 4/2015 | Matsui et al. |
| 9,522,972 | B2 | 12/2016 | Visger et al. |
| 9,598,658 | B2 | 3/2017 | Scanlon et al. |
| 9,896,634 | B2 | 2/2018 | Gao et al. |
| 9,944,877 | B2 | 4/2018 | Gao et al. |
| 10,513,668 | B2 | 12/2019 | Ransom et al. |
| 11,111,454 | B2 | 9/2021 | David et al. |
| 11,130,927 | B2 | 9/2021 | Horita et al. |
| 2007/0037715 | A1 | 2/2007 | Okada |
| 2008/0194442 | A1 | 8/2008 | Watts et al. |
| 2008/0302422 | A1 | 12/2008 | Neveu et al. |
| 2009/0298729 | A1* | 12/2009 | Schober ..... C10M 167/00 508/370 |
| 2009/0318316 | A1 | 12/2009 | Morishima |
| 2010/0093578 | A1* | 4/2010 | Tsujimoto ..... C10M 167/00 508/430 |
| 2012/0132166 | A1 | 5/2012 | Andoh et al. |
| 2012/0208731 | A1 | 8/2012 | Lann et al. |
| 2012/0283159 | A1 | 11/2012 | Matsui et al. |
| 2013/0029892 | A1* | 1/2013 | Yamada ..... C10M 169/041 508/363 |
| 2013/0196888 | A1 | 8/2013 | Truong-Dinh |
| 2013/0244917 | A1 | 9/2013 | Obrecht et al. |
| 2014/0107000 | A1 | 4/2014 | Ivancic et al. |
| 2014/0249061 | A1 | 9/2014 | Youn et al. |
| 2014/0296118 | A1 | 10/2014 | Costello et al. |
| 2014/0342960 | A1 | 11/2014 | Miller et al. |
| 2015/0247104 | A1 | 9/2015 | Brekan et al. |
| 2015/0322322 | A1 | 11/2015 | Sondjaja, et al. |
| 2016/0108337 | A1 | 4/2016 | Abraham et al. |
| 2017/0088789 | A1* | 3/2017 | Grisso ..... C10M 157/00 |
| 2017/0130161 | A1 | 5/2017 | Vettel et al. |
| 2017/0137739 | A1 | 5/2017 | Narine et al. |
| 2017/0306259 | A1 | 10/2017 | Ding et al. |
| 2018/0072962 | A1 | 3/2018 | Wada et al. |
| 2018/0079990 | A1 | 3/2018 | Aoyama |
| 2018/0100114 | A1 | 4/2018 | Gao et al. |
| 2018/0100115 | A1 | 4/2018 | Gao et al. |
| 2018/0100117 | A1 | 4/2018 | Flores-Torres et al. |
| 2018/0100118 | A1 | 4/2018 | Flores-Torres et al. |
| 2018/0100119 | A1 | 4/2018 | Aoyama |
| 2018/0134983 | A1 | 5/2018 | Broutin et al. |
| 2018/0148663 | A1* | 5/2018 | Andoh ..... C10M 163/00 |
| 2018/0327687 | A1 | 11/2018 | Kwak |
| 2019/0002785 | A1 | 1/2019 | Sanson et al. |

(Continued)

FOREIGN PATENT DOCUMENTS

| | | | |
|---|---|---|---|
| JP | 2003027077 | A | 7/2001 |
| JP | 2009242547 | A | 10/2009 |

(Continued)

OTHER PUBLICATIONS

European Search Report issued in Application No. 23198785.0 dated Mar. 21, 2024, 8 pages.

*Primary Examiner* — Vishal V Vasisth

(74) *Attorney, Agent, or Firm* — Honigman LLP

(57) ABSTRACT

The present disclosure relates to lubricating compositions configured for motorcycles and also to methods of lubricating a motorcycle engine, transmission, and clutch assembly with a single lubricating composition that is generally provided from a common sump or reservoir to achieve improved fuel economy.

7 Claims, No Drawings

(56) References Cited

U.S. PATENT DOCUMENTS

| | | | |
|---|---|---|---|
| 2019/0002790 | A1 | 1/2019 | Sanson et al. |
| 2019/0024007 | A1* | 1/2019 | Lim ..... C10M 135/18 |
| 2019/0112541 | A1 | 4/2019 | Hamachi |
| 2019/0367830 | A1 | 12/2019 | Iwai |
| 2020/0033218 | A1 | 1/2020 | Sato et al. |
| 2020/0048576 | A1 | 2/2020 | Horita et al. |
| 2020/0248095 | A1 | 8/2020 | Guerin |
| 2020/0277542 | A1 | 9/2020 | Salvi et al. |
| 2021/0139805 | A1 | 5/2021 | Champagne |
| 2021/0179961 | A1 | 6/2021 | Nga et al. |
| 2021/0253928 | A1 | 8/2021 | Lacroix et al. |
| 2021/0253971 | A1 | 8/2021 | Lacroix et al. |
| 2021/0277322 | A1 | 9/2021 | Lacroix et al. |

FOREIGN PATENT DOCUMENTS

| | | | |
|---|---|---|---|
| JP | 2010-090250 | A | 4/2010 |
| JP | 2012031359 | A | 2/2012 |
| JP | 2012-131986 | A | 7/2012 |
| JP | 2013-185087 | A | 9/2013 |
| JP | 2014025081 | A | 2/2014 |
| JP | 2015098592 | A | 5/2015 |
| JP | 2019-038995 | A | 3/2019 |
| JP | 2019533736 | A | 11/2019 |
| WO | 2014186318 | A1 | 11/2014 |
| WO | 2015/152143 | A1 | 10/2015 |
| WO | 2017189277 | A1 | 11/2017 |
| WO | 2017210388 | A1 | 12/2017 |
| WO | 2018139130 | A1 | 8/2018 |

* cited by examiner

LUBRICATING COMPOSITION FOR FUEL EFFICIENT MOTORCYCLE APPLICATIONS

TECHNICAL FIELD

The present disclosure relates to lubricating compositions and, in particular, lubricating compositions suitable for motorcycle applications.

BACKGROUND

In a motorcycle, a common fluid provides lubrication to the engine as well as driveline components including a transmission and/or a wet clutch. As such, lubricating compositions used in motorcycle engines are formulated to have a balance of both friction properties suitable for the driveline and lubrication properties suitable for the engine. This is in contrast to lubricants for other vehicles, such as passenger cars, where the engine or crankcase is lubricated by one type of lubricant and the driveline is lubricated with a second type of lubricant. This dual-purpose fluid in motorcycle applications causes formulation challenges because it is often desirable to reduce viscosity and friction in the engine crankcase to improve fuel economy but, on the other hand, it is important to maintain sufficient friction in a transmission and/or clutch assembly for proper operation. Thus, lubricants formulated for passenger car applications are generally not suitable for motorcycle applications because the passenger car fluid may exhibit, among other features, too low of a coefficient of friction for lubricating the transmission and/or clutch componentry of most motorcycles.

In view of the unique challenges for motorcycle lubricants, the industry has developed standards to properly evaluate lubricant quality and performance for motorcycle applications. In particular, JASO T 903:2016 defines performance demands for motorcycle lubricants and requires, among other criteria, certain high temperature high shear viscosity minimums (HTHS) to meet friction and/or wear requirements for the transmissions and/or clutch assemblies in the motorcycle. Traditionally, the HTHS demands for motorcycle lubricants tends to limit the viscosity grades suitable for such application to 10W-30 or higher viscosity grade lubricants. It has previously not been possible to formulate a lower viscosity motorcycle lubricant that achieved passing HTHS and wet clutch performance requirements.

SUMMARY

In one approach or embodiment, the present disclosure relates to a method of improving the fuel economy of a motorcycle using a lubricating oil composition. The method includes lubricating an engine crankcase and a transmission including a wet clutch of the motorcycle with a lubricating oil composition from a common sump. The lubricating composition has a viscosity grade selected from 0W-20, 0W-16, 0W-12, or 0W-8 and includes (a) at least one base oil of lubricating viscosity; (b) a non-dispersant poly(meth) acrylate copolymer viscosity modifier having a weight average molecular weight of about 500,000 or less and optionally (c) a molybdenum dialkyl dithiocarbamate. The lubricating composition has a high-temperature high shear (HTHS) viscosity at 150° C. of at least 2.9 cP and a clutch friction rating of MA, MA1, MA2, or MB when measured pursuant to JASO T 903:2016 and wherein the fuel economy of the motorcycle is improved as measured pursuant to a WMTC cycle of at least 1 percent better than as measured using WMTC cycle when the motorcycle is lubricated with a higher viscosity grade 10W-30 lubricant.

In other embodiments, the method of the previous paragraph may also include embodiments having optional features or steps in any combination. The optional features, steps, or embodiments may include one or more of the following: wherein the lubricating composition has a KV100 of less than 10 cP and, preferably, about 6 to about 9 cP; and/or wherein the lubricating composition has a viscosity index of about 250 to about 350; and/or wherein the non-dispersant poly(meth)acrylate copolymer has polymerized monomer units including at least (meth)acrylate monomer units with a hydrocarbyl group in the monomer ester moiety of up to about 700 and optionally (meth)acrylate monomer units with a hydrocarbyl group in the monomer ester moiety of about 6,000 to about 8,000; and/or wherein the non-dispersant poly(meth)acrylate copolymer has a weight average molecular weight of about 200,000 to about 500,000 with a polydispersity index of about 1.5 to about 2.5 and includes only (meth)acrylate monomer units with a hydrocarbyl group in the monomer ester moiety of about 500 to about 700; and/or wherein the lubricating composition includes about 10 to about 20 weight percent of the poly (meth)acrylate copolymer; and/or wherein the lubricating composition is devoid of the molybdenum dialkyl dithiocarbamate; and/or wherein the lubricating composition about 800 ppm or less of molybdenum provided from the molybdenum dialkyl dithiocarbamate; and/or wherein the motorcycle has an engine capacity of 150 $cm^3$ or less.

In other embodiments, the present disclosure also describes a method of lubricating a crankcase and a wet clutch of a motorcycle where the method includes lubricating an engine crankcase and a transmission including a wet clutch of the motorcycle with a lubricating oil composition from a common sump and wherein the lubricating composition has (i) a viscosity grade selected from 0W-20, 0W-16, 0W-12, or 0W-8; (ii) about 5 to about 20 weight percent of a polymeric viscosity modifier selected from an ethylene-propylene olefin copolymer and/or a non-dispersant poly (meth)acrylate copolymer, wherein the polymeric viscosity modifier has a weight average molecular weight of about 20,000 to about 500,000; and (iii) optionally including about 800 ppm or less of molybdenum provided from a molybdenum dialkyl dithiocarbamate friction modifier. In approaches, the lubricating composition exhibits (i) a clutch friction rating of MA, MA1, MA2, or MB when measured pursuant to JASO T 903:2016 and (ii) exhibits a high temperature high shear (HTHS) viscosity at 150° C. pursuant to JASO T 903:2016 within about 20 percent of a HTHS viscosity of a 10W-30 lubricant; and wherein the motorcycle lubricated with the lubricating oil composition has a fuel economy measured pursuant to the WMTC cycle of at least 1 percent better than the fuel economy measured on the motorcycle when lubricated with a higher viscosity grade 10W-30 lubricant.

In other embodiments, the method of the previous paragraph may further include embodiments having optional features or steps in any combination. The optional features, steps, or embodiments may include one or more of the following: wherein the lubricating composition has a high-temperature high shear (HTHS) viscosity at 150° C. of at least 2.9 cP when measured pursuant to JASO T 903:2016; and/or wherein the lubricating composition has a viscosity index of about 160 to about 350; and/or wherein the polymeric viscosity modifier is the non-dispersant poly(meth) acrylate copolymer having, as polymerized monomer units, at least (meth)acrylate monomer units with a hydrocarbyl group in the monomer ester moiety of about 500 to about 700 and optionally (meth)acrylate monomer units with a hydrocarbyl group in the monomer ester moiety of about 6,000 to about 8,000; and/or wherein the polymeric viscosity modifier has a weight average molecular weight of about 200,000 to about 300,000; and/or wherein the lubricating composition has as a KV100 viscosity of less than 10 cP; and/or wherein the motorcycle has an engine capacity of 150 $cm^3$ or less.

In yet other embodiments, a motorcycle lubricating composition is described herein effective to lubricate both an engine crankcase and a transmission including a wet clutch. In approaches, the motorcycle lubricating composition has a viscosity grade selected from 0W-20, 0W-16, 0W-12, or 0W-8 and further includes at least one base oil of lubricating viscosity; a non-dispersant poly(meth)acrylate copolymer viscosity modifier having a weight average molecular weight of about 20,000 to about 450,000 and optionally having as polymerized monomer units (meth)acrylate monomer units with a hydrocarbyl group in the monomer ester moiety of up to about 700; a viscosity index of about 250 to about 350; about 800 ppm or less of molybdenum provided from a molybdenum dialkyl dithiocarbamate; and wherein the lubricating composition has a high-temperature high shear (HTHS) viscosity at 150° C. of at least 2.9 cP and a clutch friction rating of MA, MA1, MA2, or MB when measured pursuant to JASO T 903:2016; and wherein a motorcycle lubricated with the lubricating composition exhibits a fuel economy measured pursuant to a WMTC cycle of at least 1 percent better than the fuel economy measured on the motorcycle when lubricated with a higher viscosity grade 10W-30 lubricant.

In other embodiments, the motorcycle lubricating composition of the previous paragraph may further include embodiments having optional features or components in any combination. The optional features, components, or embodiments may include one or more of the following: wherein the lubricating composition has a KV100 of less than 10 cP and, preferably, about 6 to about 9 cP; and/or wherein the lubricating composition includes about 10 to about 20 weight percent of the non-dispersant poly(meth)acrylate copolymer; and/or wherein the lubricating composition is devoid of the molybdenum dialkyl dithiocarbamate friction modifier; and/or wherein the lubricating composition includes about 10 ppm to about 800 ppm of molybdenum provided from the molybdenum dialkyl dithiocarbamate; and/or wherein the motorcycle has an engine capacity of 150 $cm^3$ or less.

DETAILED DESCRIPTION

The present disclosure relates to lubricating compositions configured for motorcycles and also to methods of lubricating a motorcycle engine, transmission, and clutch assembly with a single lubricating composition that is generally provided from a common sump or reservoir. As noted in the Background, lubricants for motorcycles are required to lubricant more than just the engine crankcase. Motorcycle lubricants also lubricate the driveline componentry including transmissions and clutches as well. Thus, the testing and demands on the fluid are quite different from typical lubricants for passenger car motor oils.

In particular, high temperature high shear viscosity (HTHS) and wet clutch performance are unique demands for motorcycle lubricants. Tables 1 and 2 below provide an overview of motorcycle oil standards as set by JASO T903:2016. As shown in Table 1, the minimum value of the HTHS viscosity of 2.9 cP was determined in consideration of the transmission and clutch protection performance, and as noted in the background, this minimum value tended to previously limit the viscosity grade of motorcycle engine oil to T0W-30 or higher. Attempting to achieve such high temperature viscosities has been problematic when lowering fluid viscosities of motorcycle lubricants.

TABLE 1

Motorcycle Physical properties requirement in JASO T903: 2016

| Test Item | | Unit | Criteria | Test procedure |
|---|---|---|---|---|
| Sulfated ash | | mass % | 1.2 max | JIS K 2272 |
| Phosphorous content | | mass % | >=0.08 and <=0.12 | JPI-5S-38 |
| Evaporative loss | | mass % | 20 max | JPI-5S-41 |
| Foaming tendency | Seq I | mL | 10/0 max. | JIS K 2518 |
| (foaming/settling) | Seq II | | 50/0 max. | |
| | Seq III | | 10/0 max. | |
| Shear stability | | $mm^2/s$ | xW-30: 9.0 min | ASTM D6278[b] |
| (Kinematic viscosity (100° C.) after the test) | | | xW-40: 12.0 min | |
| | | | xW-50: 15.0 min | |
| | | | Other grades: stay in grade[a] | |
| High temperature high shear viscosity | | mPa · s | 2.9 min. | JPI-5S-36 |

[a]Refer to SAE J300 for the viscosity.

[b]The test shall be conducted by the diesel injector method under the standard test conditions (30 cycles).

TABLE 2

| Motorcycle Wet clutch performance requirement in JASO T903: 2016 | | | | |
|---|---|---|---|---|
| | Index performance criteria[a] | | | |
| Rated parameter | MA[b] | MA2[b] | MA1[b] | MB[c] |
| Dynamic friction index (DFI) | >=1.35 and <2.50 | >=1.50 and <2.50 | >=1.35 and <1.50 | >=0.40 and <1.35 |
| Static friction index (SFI) | >=1.45 and <2.50 | >=1.60 and <2.50 | >=1.45 and <1.60 | >=0.40 and <1.45 |
| Stop time index (STI) | >=1.40 and <2.50 | >=1.60 and <2.50 | >=1.40 and <1.60 | >=0.40 and <1.40 |

Developing a lower viscosity motorcycle lubricating composition that also achieves HTHS performance and wet clutch performance has the added benefit of improved fuel economy. Unexpectedly, the lubricating compositions herein having a lower viscosity grade of 0W-20, 0W-16, 0W-12, or 0W-8 achieve HTHS and wet clutch performance levels of a higher viscosity T0W-30 lubricant. Such lubricating compositions also achieve higher fuel economy (as compared to a T0W-30 baseline lubricant) of at least 1 percent or better, at least 1.2 percent or better, at least 1.4 percent or better, at least 1.6 percent or better, or at least 1.8 percent or better (or any ranges therebetween) without affecting the specific performance requirements of the motorcycle engine oil, such as transmission protection performance and clutch performance.

In one approach or embodiment, a method of improving the fuel economy of a motorcycle (such as a motorcycle having an engine capacity of 150 cc or less) using a select lubricating oil composition configured to also achieve required transmission protection and clutch performance in a lower viscosity and, in particular, a KV100 of about 10 cP or less, or about 6 to about 9 cP. In one aspect, the method includes lubricating an engine crankcase and a transmission including a wet clutch of the motorcycle with a lubricating oil composition from a common sump. The lubricating composition has a viscosity grade selected from 0W-20, 0W-16, 0W-12, or 0W-8 and includes (a) at least one base oil of lubricating viscosity; (b) a polymeric viscosity modifier selected from either an ethylene-propylene olefin copolymer or a non-dispersant poly(meth)acrylate copolymer having a weight average molecular weight of about 500,000 or less and optionally including (c) a molybdenum dialkyl dithiocarbamate. In one approach, the methods and the lubricating compositions thereof exhibit a high-temperature high shear (HTHS) viscosity at 150° C. of at least 2.9 cP and a clutch friction rating of MA, MA1, MA2, or MB when measured pursuant to JASO T 903:2016. In another approach, the methods and the lubricating compositions thereof exhibit a HTHS viscosity at 150° C. within +/−20 percent of a HTHS viscosity of a 10W-30 lubricant (in other approaches, a HTHS viscosity within about 15 percent, within about 14 percent lower, or within about 12 percent of the HTHS viscosity of a 10W-30 lubricant). Even with such low viscosity grades and passing friction and clutch performance, a measured fuel economy of the motorcycle when lubricated with the fluids herein is improved as measured pursuant to the World Motorcycle Test cycle (WMTC) of at least about 1 percent better than the fuel economy of a motorcycle lubricated with a higher viscosity grade 10W-30 lubricant (in other approaches, at least 1.2 percent or better, at least 1.4 percent or better, at least 1.6 percent or better, or at least 1.8 percent or better (or any ranges therebetween)). Such methods and lubricating oil compositions are particularly suited for Class-1 motorcycles under the WMTC having an engine capacity of 150 cc or less or, in other embodiments, about 80 to about 130 cc, or about 100 to about 130 cc.

The motorcycle lubricating compositions herein include select polymeric viscosity modifiers that exhibit a higher viscosity index and unexpectedly achieve passing HTHS viscosities and also wet-clutch performance in low viscosity lubricants achieving improved fuel economy as compared to higher viscosity 10W-30 lubricants. Suitable polymeric viscosity modifiers may include ethylene-propylene olefin copolymers, non-dispersant poly(meth)acrylate copolymers, or combinations thereof when certain characteristics of the viscosity modifiers are met. Lubricating compositions herein may have a higher than normal viscosity index for motorcycle lubricants of about 160 to about 350 with the select polymeric additives of this disclosure. Each suitable polymeric additive will be described further below.

Poly(Meth)Acrylate Copolymer

In one aspect, the motorcycle lubricants herein include select poly(meth)acrylate copolymers. In some approaches, the select poly(meth)acrylate copolymers are configured to achieve a higher viscosity index of the lubricants herein as compared to prior motorcycle lubricants, and in other approaches, the select poly(meth)-acrylate copolymers may also have certain molecular weights and/or certain pendant side groups or arms that may be a blend of one or more distinct molecular weight pendant arms, such as low molecular weight, intermediate molecular weight, and/or high molecular weight pendant hydrocarbyl groups in ester moieties of (meth)acrylate monomer units forming the copolymer. In embodiments, the lubricants herein may include up to about 20 weight percent of the poly(meth)acrylate copolymers, in other approaches, about 3 to about 18 weight percent, or about 4 to about 16 weight percent. Polymer treat rates are provided on a liquid (diluted in base oil) basis unless otherwise indicated. In one exemplary approach, a poly(meth)acrylate copolymer may have the structure of Formula I below with z being an integer sufficient to achieve a weight average molecular weight of about 20,000 to about 1,500,00 (in other approaches, about 100,000 to about 500,000, or about 200,000 to about 450,000, or about 200,000 to about 300,000) and wherein R is hydrogen if the monomer unit is an acrylate and a methyl group if the monomer unit is a methacrylate and R' is a liner or branched hydrocarbyl group sized to achieve the arm molecular weights as described herein:

(Formula I)

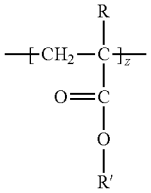

Lubricants including the poly(meth)acrylate copolymers herein may have a viscosity index (as determined by ASTM D2270) of about 250 to about 350, preferably about 270 to about 320, or more preferably about 280 to about 310. The poly(meth)acrylate copolymers herein may have different (meth)acrylate monomer units randomly spaced throughout the polymer as described below.

Monomers or reactants suitable to form this copolymer for the unique motorcycle fluids herein include at least one, and optionally, a blend of at least two distinct (meth)acrylate monomers or reactants selected from: (1) (meth)acrylate monomers with a low to intermediate weight average molecular weight hydrocarbyl group(s) in the ester moiety of up to about 700, or preferably, about 100 to about 700 or about 400 to about 700 and, optionally, (2) (meth)acrylate monomers with a high weight average molecular weight hydrocarbyl groups in the ester moiety of the monomers of about 6,000 to about 10,000 or about 6,000 to about 8,000. As used herein, "(meth)acrylate" refers to both methacrylate and/or acrylate monomers or monomer units (or mixtures). As also used herein, molecular weight of the ester hydrocarbyl groups in the monomer includes the hydrocarbyl chain as well as the ester oxygen, but does not include the carbonyl group.

Typically, the formed or resultant poly(meth)acrylate copolymers have monomer amounts effective to achieve a number average molecular weight of the total copolymer of about 20,000 or more, and in some instances, about 250,000 or less or about 200,000 or less, such as about 140,000 to about 240,000 or about 140,000 to about 200,000. The poly(meth)acrylate copolymer may also have a polydispersity index (Mw/Mn) of about 2.8 or less, or about 2.6 or less and, in other approaches, ranging from about 1.8 to about 2.6. In yet other approaches, the copolymers herein may have two differently sized pendant arms and, in such context, have a molecular weight ratio between higher and lower molecular weight arms of about 10:1 to about 50:1, in other approaches, about 11:1 to about 30:1, and in yet other approaches, about 12:1 to about 25:1. In other instances, the copolymers herein have a molecular weight ratio between higher and lower molecular weight arms of about 1.5:1 to about 25:1, and in other approaches, about 1.5:1 to about 16:1.

In approaches or embodiments, the poly(meth)acrylate copolymers herein include a reaction product in the form of a linear, random copolymer of select amounts of the low to intermediate and/or (optional) high molecular weight pendant hydrocarbyl (meth)acrylate monomers. These monomers and monomer units are described more below and include both linear and/or branched hydrocarbyl groups in the respective ester chains and, in some embodiments, form comb-like copolymers with at least one and, optionally, at least the two distinct molecular weight pendant arms.

In embodiments or approaches, the low molecular weight hydrocarbyl (meth)acrylate units or monomers are derived from alkyl (meth)acrylates with a linear or branched hydrocarbyl group in the ester moiety, and preferably a linear or branched alkyl group in the ester moiety, with a total carbon chain length of the monomer ester moiety (including any branching) from 6 to 20 carbons, and preferably, 12 to 16 carbons. An exemplary low molecular weight hydrocarbyl (meth)acrylate monomer may be lauryl (meth)acrylate that may include a blend of (meth)acrylate monomers or monomer units having alkyl chain lengths ranging from C12 to C16 and, in particular, alkyl chains of 12, 14, and 16 carbons in the blend, of which C12 alkyl (meth)acrylates are the majority. In other embodiments or approaches, the low or intermediate molecular weight hydrocarbyl (meth)acrylate units are derived from hydrocarbyl (meth)acrylate monomers with a hydrocarbyl group or a total hydrocarbyl ester length (including any branching) with a weight average molecular weight of at least about 500 and up to about 700. These molecular weight chains can be derived from olefins or, optionally, macromonomers of polymeric alcohols esterified with (meth)acrylic acid. The macromonomers may be derived from alkenes or alkadienes including ethylene, propylene, butene, butadiene, isoprene, or combinations thereof and have a molecular weight of about 700 or less, such as about 500 to about 700.

In yet other embodiments or approaches, the optional high molecular weight hydrocarbyl (meth)acrylate units or monomer are derived from hydrocarbyl (meth)acrylates with a hydrocarbyl group or a total hydrocarbyl ester length (including any branching) with a weight average molecular weight of at least about 6,000 and up to about 10,000 or about 6,000 to about 8,000. These high molecular weight chains can be derived from macromonomers of polymeric alcohols esterified with (meth)acrylic acid. The macromonomers may be derived from alkenes or alkadienes including ethylene, propylene, butene, butadiene, isoprene, or combinations thereof and have a molecular weight of about 10,000 or less or about 8,000 or less, such as about 500 to about 10,000, or about 6,000 to about 8,000.

In optional embodiments, the poly(meth)acrylate copolymers herein may also include other optional monomers and monomer units including, for instance, hydroxyalkyl (meth) acrylate and/or various dispersant monomers and monomer units. The poly(meth) acrylate copolymers herein may also optionally be functionalized with one or more dispersant monomer or monomer units; however, it is preferred that the poly(meth)acrylate copolymers are non-dispersant polymers and, thus, free-of or devoid of dispersant moieties as noted herein.

In one optional approach, a dispersant monomer or monomer unit may be nitrogen-containing monomers or units thereof. Such monomers, if used, may impart dispersant functionality to the polymer. In some approaches, the nitrogen-containing monomers may be (meth)acrylic monomers such as methacrylates, methacrylamides, and the like. In some approaches, the linkage of the nitrogen-containing moiety to the acrylic moiety may be through a nitrogen atom or alternatively an oxygen atom, in which case the nitrogen of the monomer will be located elsewhere in the monomer. The nitrogen-containing monomer may also be other than a (meth)acrylic monomer, such as vinyl-substituted nitrogen heterocyclic monomers and vinyl substituted amines. Nitrogen-containing monomers include those, for instance, in U.S. Pat. No. 6,331,603. Other suitable dispersant monomers include, but are not limited to, dialkylaminoalkyl acrylates, dialkylaminoalkyl (meth)acrylates, dialkylaminoalkyl acrylamides, dialkylaminoalkyl methacrylamides, N-tertiary alkyl acrylamides, and N-tertiary alkyl methacrylamides, where the alkyl group or aminoalkyl groups may contain, independently, 1 to 8 carbon atoms. For instance, the dispersant monomer may be dimethylaminoethyl(meth) acrylate. The nitrogen-containing monomer may be, for instance, t-butyl acrylamide, dimethylaminopropyl (meth) acrylamide, dimethylaminoethyl methacrylamide, N-vinyl pyrrolidone, N-vinylimidazole, or N-vinyl caprolactam. It may also be a (meth)acrylamide based on any of the aromatic amines disclosed in WO2005/087821 including 4-phenylazoaniline, 4-aminodiphenylamine, 2-aminobenzimidazole, 3-nitroaniline, 4-(4-nitrophenylazo)aniline, N-(4-amino-5-methoxy-2-methyl-phenyl)-benzamide, N-(4-amino-2,5-dimethoxy-phenyl)-benzamide, N-(4-amino-2,5-diethoxy-phenyl)-benzamide, N-(4-amino-phenyl)-benzamide, 4-amino-2-hydroxy-benzoic acid The (meth)acrylate copolymers of the present disclosure are typically synthesized to have a number average molecular weight of about 20,000 or more, in other approaches, about 250,000 or less or about 200,000 or less. Suitable ranges for the number average molecular weights include, about 140,000 to about 250,000, and in other approaches, about 150,000 to about 200,000. Such copolymers herein typically have a polydispersity index ranging from about 1 to about 4, and in other approaches, about 1.2 to about 3.5, and in yet other approaches, about 1.5 to about 3, and in yet other approaches, about 1.6 to about 2.5.

The (meth)acrylate copolymers may be prepared by any suitable conventional or controlled free-radical polymerization technique. Examples include conventional free radical polymerization (FRP), reversible addition-fragmentation chain transfer (RAFT), atom transfer radial polymerization (ATRP), and other controlled types of polymerization known in the art. Polymerization procedures are known to those in the art and include, for instance, the use of common polymerization initiators (such as Vazo™ 67 (2.2'-Azobis (2-methylbutyronitrile), chain transfer agents (such as dodecyl mercaptane) if using conventional FRP, or RAFT agents (such as 4-cyano-4-[(dodecylsulfanylthiocarbonyl) sulfanyl] pentanoic acid and the like) if using RAFT polymerization. Other initiators, chain transfer agents, RAFT agents, ATRP catalyst and initiator systems can be used as known in the art depending on the selected polymerization method as needed for a particular application.

Olefin Copolymer

In another embodiment, the polymeric viscosity modifier for the motorcycle lubricants herein may be an olefin copolymer derived from ethylene and one or more $C_3$ to $C_{10}$ alpha-olefins. The one or more $C_3$ to $C_{10}$ alpha-olefins may be for example $C_3$ or $C_4$ alpha-olefins. Preferably, copolymers of ethylene and propylene or ethylene and butylene may be used. In embodiments, the lubricants herein may include up to about 15 weight percent, or in other approaches, about 3 to about 14 weight percent of the olefin copolymers, in other approaches, about 4 to about 12 weight percent, or about 6 to about 10 weight percent. Polymer treat rates are provided on a liquid (dilute in base oil) basis unless otherwise indicated. In one exemplary approach, an olefin copolymer may have the structure of Formula II below with m and n being integers sufficient to achieve a weight average molecular weight of about 20,000 to about 250,000 and wherein the monomers associated with m and n are randomly spaced within the polymer:

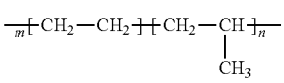

(Formula II)

Lubricants including the polyolefin copolymers herein may also have a viscosity index higher than prior motorcycle lubricants and, in approaches, may have a viscosity index (as determined by ASTM D2270) of about 160 to about 220, preferably about 170 to about 210, or more preferably about 170 to about 200. While Formula II exemplifies ethylene and propylene monomers, any of the monomers as described herein may form an olefin copolymer similar to that of Formula II.

In some instances, more complex olefin polymers, often designated as interpolymers, may be prepared using at least three monomers. For example, the monomers may include ethylene, propylene, and a third monomer selected from C4 to C10 alpha-olefins and/or non-conjugated dienes and trienes. The non-conjugated diene component is one having from 5 to 14 carbon atoms in the chain. Preferably, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norbornene, 1,5-heptadiene, and 1,6-octadiene. A mixture of more than one diene can be used in the preparation of the interpolymer. A preferred non-conjugated diene for preparing a terpolymer or interpolymer substrate is 1,4-hexadiene. The triene component will have at least two non-conjugated double bonds, and up to about 30 carbon atoms in the chain. Typical trienes useful in preparing the interpolymer of this disclosure are 1-isopropylidene-3a,4,7,7a-tetra hydroindene, 1-isopropylidene dicyclopentadiene, dihydro-isodicyclo pentadiene, and 2-(2-methylene-4-methyl-3-pentenyl) [2.2.1] bicyclo-5-heptene.

Ethylene-propylene or higher alpha-olefin copolymers may include, for instance, about 15 to about 80 mole percent ethylene and from about 85 to about 20 mole percent $C_3$ to $C_{10}$ alpha-olefin with preferred mole ratios being from about 35 to about 75 mole percent ethylene and about 65 to about 25 mole percent of a C3 to $C_{10}$ alpha-olefin, with more preferred mole ratios being about 50 to about 70 mole percent ethylene and about 50 to about 30 mole percent $C_3$ to $C_{10}$ alpha-olefin, and the most preferred proportions being about 55 to about 65 mole percent ethylene and about 45 to about 35 mole percent $C_3$ to $C_{10}$ alpha-olefin. In yet other approaches, olefin copolymers herein may have about 40 to about 60 mole percent ethylene and from about 60 to about 40 mole percent $C_3$ to $C_{10}$ alpha-olefin. In any embodiment herein, ethylene and propylene are preferred comonomers for the olefin copolymer. Terpolymer variations of the foregoing polymers may contain from about 0.1 to 10 mole percent of a non-conjugated diene or triene.

In some approaches, the terms polymer and copolymer are used generically to encompass copolymers, terpolymers, or interpolymers. As noted, preferably the olefin copolymers are ethylene-propylene copolymers, but these materials may contain minor amounts of other olefinic monomers so long as the basic characteristics of the ethylene copolymers are not materially changed.

In some approaches or embodiments, the weight average molecular weight of the olefin copolymer viscosity modifiers may be about 20,000 to about 1,500,000; in other approaches, about 20,000 to about 1,000,000; in other approaches, about 100,000 to about 500,000; in other approaches, about 100,000 to about 300,000; in other approaches, about 100,000 to about 250,000 as determined by gel permeation chromatography (GPC) using polystyrene as a calibration reference. In yet other approaches, the number average molecular weight of the olefin copolymer viscosity modifiers may range from about 20,000 to about 500,000; about 50,000 to about 300,000; about 75,000 to about 250,000; about 90,000 to about 200,000; or about 100,000 to about 150,000.

Oil Soluble Molybdenum Compounds

The motorcycle lubricants herein may optionally include one or more oil soluble molybdenum-containing compounds. An oil-soluble molybdenum compound may have the functional performance of an antiwear agent, an antioxidant, a friction modifier, or mixtures thereof and was previously thought necessary to achieve fuel economy targets in motorcycle applications, but are optional in the formulations herein. The oil-soluble molybdenum compound may be any of molybdenum dithiocarbamates, molybdenum dialkyl dithiophosphates, molybdenum sulfides, molybdenum disulfides, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum-containing compounds may be sulfur-containing or sulfur-free compounds. The molybdenum disulfide may be in the form of a stable dispersion.

In one embodiment the oil-soluble molybdenum compound may be selected from the group of molybdenum dithiocarbamates, molybdenum dialkyldithiophosphates, sulfur-free organomolybdenum complexes of organic amides, and mixtures thereof. In one embodiment, the oil-soluble molybdenum compound may be a molybdenum dithiocarbamate. Exemplary sulfur-free organomolybdenum complexes of organic amides are disclosed in U.S. Pat. No. 5,137,647.

In one approach or embodiment, suitable molybdenum dithiocarbamates may be represented by the Formula:

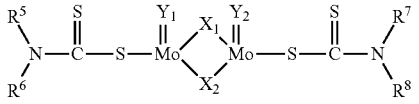

where $R^5$, $R^6$, $R^7$, and $R^8$ are each, independently, a hydrogen atom, a $C_1$ to $C_{20}$ alkyl group, a $C_6$ to $C_{20}$ cycloalkyl, aryl, alkylaryl, or aralkyl group, or a $C_3$ to $C_{20}$ hydrocarbyl group optionally containing an ester, ether, alcohol, or carboxyl group; and $X_1$, $X_2$, $Y_1$, and $Y_2$ are each, independently, a sulfur or oxygen atom. Examples of suitable groups for each of $R^5$, $R^6$, $R^7$, and $R^8$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. In other approaches, $R^5$, $R^6$, $R^7$, and $R^8$ may each have $C_6$ to Cis alkyl groups. $X_1$ and $X_2$ may be the same, and $Y_1$ and $Y_2$ may be the same. $X_1$ and $X_2$ may both comprise sulfur atoms, and $Y_1$ and $Y_2$ may both comprise oxygen atoms. Further examples of molybdenum dithiocarbamates include $C_6$-$C_{18}$ dialkyl or diaryldithiocarbamates, or alkyl-aryldithiocarbamates such as dibutyl-, diamyl-di-(2-ethylhexyl)-, dilauryl-, dioleyl-, and dicyclohexyl-dithiocarbamate.

Suitable examples of molybdenum compounds which may be used include commercial materials sold under the trade names such as Molyvan® 822, Molyvan® A, Molyvan® 2000. Molyvan® 807 and Molyvan® 855 from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. Nos. 5,650,381; RE 37,363 E1; RE 38,929 E1; and RE 40,595 E1, incorporated herein by reference in their entireties.

In one embodiment and if included in the formulations, the molybdenum compound may be present in a fully formulated motorcycle lubricant in an amount to provide up to about 800 ppm of molybdenum, or about 5 ppm to 800 ppm molybdenum. As a further example, the molybdenum compound may be present in an amount to provide from about 10 to about 500 ppm molybdenum or from about 10 to 250 ppm molybdenum or from about 10 to 175 ppm molybdenum. In other approaches, the formulations herein may be devoid of the molybdenum dialkyl dithiocarbamate, and in this context, the formulations may have about 0.05 weight percent or less of the molybdenum dialkyl dithiocarbamate, about 0.01 weight percent or less, or none.

Base Oil or Base Oil Blend:

The base oil used in the motorcycle lubricating compositions herein may be oils of lubricating viscosity and selected from any of the base oils in API Groups I to V as specified in the American Petroleum Institute (API) Base Oil Interchangeability Guidelines. The five base oil groups are generally set forth in Table 1 below:

TABLE 3

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful.

Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene isobutylene copolymers); poly(1-hexenes), poly(1-octenes), trimers or oligomers of 1-decene, e.g., poly(1-decenes), such materials being often referred to as α-olefins, and mixtures thereof, alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

The fully formulated motorcycle lubricants herein, in some approaches or embodiments, include one or more of a Group I to Group V base oils, and may have a KV100 of about 2 to about 20 cSt, in other approaches, about 2 to about 10 cSt, about 4 to about 9 cSt, in yet other approaches, about 5 to about 9 cSt, and in other approaches about 6 to about 8.5 cSt. The fully formulated lubricants herein may have viscosity grades of 0W-20, 0W-16, 0W-12, or 0W-8 and surprisingly achieve desired HTHS viscosity and clutch performance demands at the same time.

As used herein, the terms "oil composition," "lubrication composition," "lubricating oil composition," "lubricating oil," "lubricant composition," "fully formulated lubricant composition," "lubricant," and "lubricating and cooling fluid" are considered synonymous, fully interchangeable terminology referring to the finished lubrication product comprising a major amount of a base oil component plus minor amounts of the detergents and the other optional components.

Optional Additives:

The lubricating oil compositions herein may also include a number of optional additives to meet performance standards. Those optional additives are described in the following paragraphs.

Dispersants:

The lubricating oil composition may optionally include one or more other dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or U.S. Pat. No. 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482, 464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

In yet other embodiments, the optional dispersant additive may be a hydrocarbyl substituted succinamide or succinimide dispersant. In approaches, the hydrocarbyl substituted succinamide or succinimide dispersant may be derived from a hydrocarbyl substituted acylating agent reacted with a polyalkylene polyamine and wherein the hydrocarbyl substituent of the succinamide or the succinimide dispersant is a linear or branched hydrocarbyl group having a number average molecular weight of about 250 to about 5,000 as measured by GPC using polystyrene as a calibration reference.

In some approaches, the polyalkylene polyamine used to form the dispersant has the Formula

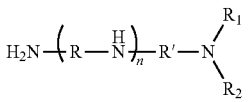

wherein each R and R', independently, is a divalent C1 to C6 alkylene linker, each $R_1$ and $R_2$, independently, is hydrogen, a C1 to C6 alkyl group, or together with the nitrogen atom to which they are attached form a 5- or 6-membered ring optionally fused with one or more aromatic or non-aromatic rings, and n is an integer from 0 to 8. In other approaches, the polyalkylene polyamine is selected from the group consisting of a mixture of polyethylene polyamines having an average of 5 to 7 nitrogen atoms, triethylenetetramine, tetraethylenepentamine, and combinations thereof.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, about 0.1 to 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

Antioxidants:

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing component treat rates is (0 to 3):(0 to 3):(0 to 3).

The one or more antioxidant(s) may be present in ranges about 0 wt % to about 20 wt %, or about 0.1 wt % to about 10 wt %, or about 1 wt % to about 5 wt %, of the lubricating oil composition.

Antiwear Agents:

The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds:

The lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Detergents:

The lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/g or greater, or as further examples, about 250 mg KOH/g or greater, or about 350 mg KOH/g or greater, or about 375 mg KOH/g or greater, or about 400 mg KOH/g or greater. The TBN being measured by the method of ASTM D2896.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1. In some embodiments, a detergent is effective at reducing or preventing rust in an engine or other automotive part such as a transmission or gear. The detergent may be present in a lubricating composition at about 0 wt % to about 10 wt %, or about 0.1 wt % to about 8 wt %, or about 1 wt % to about 4 wt %, or greater than about 4 wt % to about 8 wt %.

Extreme Pressure Agents:

The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers:

The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Other Molybdenum-Containing Component:

The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan® 822, Molyvan® A, Molyvan® 2000, Molyvan® 1055, Molyvan® 3000, and Molyvan® 855 from R. T. Vanderbilt Co., Ltd., and Adeka Sakura-Lube® S-165, S-200, S-300, S-310G, S-515, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Additional Viscosity Index Improvers:

The lubricating oil compositions herein also may optionally contain one or more additional viscosity index improvers so long as the requirements describe above are not compromised. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives:

Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricant including the detergent metals herein may include additive components in the ranges listed in the following table.

TABLE 4

Suitable Lubricating Compositions

| Component | Wt. % (Suitable Embodiments) | Wt. % (Suitable Embodiments) |
|---|---|---|
| Polymeric Viscosity Modifiers | 2-20 | 6-16 |
| Detergent Systems | 0.02-5.0 | 0.2-2.0 |
| Succinimide Dispersant(s) | 0-8.0 | 1-6.0 |
| Aminic Antioxidant(s) | 0.1-5.0 | 0.01-3.0 |
| Other Detergent(s) | 0.0-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-25.0 | 0.1-15.0 |
| Dispersant viscosity index improver(s) | 0.0-10.0 | 0.0-5.0 |
| Friction modifier(s) | 0.00-5.0 | 0.01-2.0 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

Definitions

For purposes of this disclosure, the chemical elements are identified in accordance with the Periodic Table of the Elements, CAS version, Handbook of Chemistry and Physics, 75th Ed. Additionally, general principles of organic chemistry are described in "Organic Chemistry", Thomas Sorrell, University Science Books, Sausolito: 1999, and "March's Advanced Organic Chemistry", 5th Ed., Ed.: Smith, M. B. and March, J., John Wiley & Sons, New York: 2001, the entire contents of which are hereby incorporated by reference.

As described herein, compounds may optionally be substituted with one or more substituents, such as are illustrated generally above, or as exemplified by particular classes, subclasses, and species of the disclosure.

Unless otherwise apparent from the context, the term "major amount" is understood to mean an amount greater than or equal to 50 weight percent, for example, from about 80 to about 98 weight percent relative to the total weight of the composition. Moreover, as used herein, the term "minor amount" is understood to mean an amount less than 50 weight percent relative to the total weight of the composition.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include: (1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical); (2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); (3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein the term "aliphatic" encompasses the terms alkyl, alkenyl, alkynyl, each of which being optionally substituted as set forth below.

As used herein, an "alkyl" group refers to a saturated aliphatic hydrocarbon group containing 1-12 (e.g., 1-8, 1-6, or 1-4) carbon atoms. An alkyl group can be straight or branched. Examples of alkyl groups include, but are not limited to, methyl, ethyl, propyl, isopropyl, butyl, isobutyl, sec-butyl, tert-butyl, n-pentyl, n-heptyl, or 2-ethylhexyl. An alkyl group can be substituted (i.e., optionally substituted) with one or more substituents such as halo, phospho, cycloaliphatic [e.g., cycloalkyl or cycloalkenyl], heterocycloaliphatic [e.g., heterocycloalkyl or heterocycloalkenyl], aryl, heteroaryl, alkoxy, aroyl, heteroaroyl, acyl [e.g., (aliphatic) carbonyl, (cycloaliphatic)carbonyl, or (heterocycloaliphatic) carbonyl], nitro, cyano, amido [e.g., (cycloalkylalkyl)carbonylamino, arylcarbonylamino, aralkylcarbonylamino, (heterocycloalkyl) carbonylamino, (heterocycloalkylalkyl) carbonylamino, heteroarylcarbonylamino, heteroaralkyl carbonylamino alkylaminocarbonyl, cycloalkylaminocarbonyl, heterocycloalkylaminocarbonyl, arylaminocarbonyl, or heteroarylaminocarbonyl], amino [e.g., aliphaticamino, cycloaliphatic amino, or heterocycloaliphaticamino], sulfonyl [e.g., aliphatic-$SO_2$—], sulfinyl, sulfanyl, sulfoxy, urea, thiourea, sulfamoyl, sulfamide, oxo, carboxy, carbamoyl, cycloaliphaticoxy, heterocyclo aliphaticoxy, aryloxy, heteroaryloxy, aralkyloxy, heteroarylalkoxy, alkoxycarbonyl, alkyl carbonyloxy, or hydroxy. Without limitation, some examples of substituted alkyls include carboxyalkyl (such as HOOC-alkyl, alkoxycarbonylalkyl, and alkylcarbonyloxy-alkyl), cyanoalkyl, hydroxyalkyl, alkoxyalkyl, acylalkyl, aralkyl, (alkoxyaryl)alkyl, (sulfonylamino) alkyl (such as (alkyl-$SO_2$-amino)alkyl), aminoalkyl, amidoalkyl, (cycloaliphatic)alkyl, or haloalkyl.

As used herein, an "alkenyl" group refers to an aliphatic carbon group that contains 2-8 (e.g., 2-12, 2-6, or 2-4) carbon atoms and at least one double bond. Like an alkyl group, an alkenyl group can be straight or branched. Examples of an alkenyl group include, but are not limited to allyl, isoprenyl, 2-butenyl, and 2-hexenyl. An alkenyl group can be optionally substituted with one or more substituents such as halo, phospho, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic) carbonyl, (cycloaliphatic) carbonyl, or (heterocycloaliphatic)carbonyl], nitro, cyano, amido [e.g., (cycloalkylalkyl)carbonylamino, arylcarbonylamino, aralkylcarbonylamino, (hetero cycloalkyl) carbonylamino, (heterocyclo alkylalkyl) carbonylamino, heteroarylcarbonylamino, heteroaralkylcarbonylamino alkylamino carbonyl, cycloalkylaminocarbonyl, hetero cyclo alkylaminocarbonyl, arylaminocarbonyl, or heteroarylaminocarbonyl], amino [e.g., aliphaticamino, cycloaliphaticamino, heterocyclo aliphaticamino, or aliphaticsulfonylamino], sulfonyl [e.g., alkyl-$SO_2$—, cycloaliphatic-$SO_2$—, or aryl-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroaralkoxy, alkoxycarbonyl, alkylcarbonyloxy, or hydroxy. Without limitation, some examples of substituted alkenyls include cyanoalkenyl, alkoxyalkenyl, acylalkenyl, hydroxyl alkenyl, aralkenyl, (alkoxyaryl) alkenyl, (sulfonylamino)alkenyl (such as (alkyl-$SO_2$-amino) alkenyl), aminoalkenyl, amidoalkenyl, (cycloaliphatic)alkenyl, or haloalkenyl.

As used herein, an "alkynyl" group refers to an aliphatic carbon group that contains 2-8 (e.g., 2-12, 2-6, or 2-4) carbon atoms and has at least one triple bond. An alkynyl group can be straight or branched. Examples of an alkynyl group include, but are not limited to, propargyl and butynyl. An alkynyl group can be optionally substituted with one or more substituents such as aroyl, heteroaroyl, alkoxy, cycloalkyloxy, heterocycloalkyloxy, aryloxy, heteroaryloxy, aralkyl oxy, nitro, carboxy, cyano, halo, hydroxy, sulfo, mercapto, sulfanyl [e.g., aliphaticsulfanyl or cycloaliphaticsulfanyl], sulfinyl [e.g., aliphaticsulfinyl or cycloaliphaticsulfinyl], sulfonyl [e.g., aliphatic-$SO_2$—, aliphaticamino-$SO_2$—, or cycloaliphatic-$SO_2$—], amido [e.g., aminocarbonyl, alkylaminocarbonyl, alkylcarbonylamino, cyclo alkylaminocarbonyl, heterocycloalkylaminocarbonyl, cycloalkylcarbonylamino, arylamino carbonyl, arylcarbonylamino, aralkylcarbonylamino, (heterocycloalkyl) carbonylamino, (cycloalkylalkyl) carbonylamino, heteroaralkylcarbonylamino, heteroaryl carbonylamino or heteroaryl amino carbonyl], urea, thiourea, sulfamoyl, sulfamide, alkoxycarbonyl, alkyl carbonyloxy, cyclo aliphatic, heterocycloaliphatic, aryl, heteroaryl, acyl [e.g., (cycloaliphatic) carbonyl or (hetero cyclo aliphatic)carbonyl], amino [e.g., aliphaticamino], sulfoxy, oxo, carboxy, carbamoyl, (cycloaliphatic)oxy, (heterocyclo aliphatic) oxy, or (heteroaryl) alkoxy.

As used herein, an "amino" group refers to —$NR^XR^Y$ wherein each of $R^X$ and $R^Y$ is independently hydrogen, alkyl, cycloakyl, (cycloalkyl)alkyl, aryl, aralkyl, heterocycloalkyl, (heterocycloalkyl)alkyl, heteroaryl, carboxy, sulfanyl, sulfinyl, sulfonyl, (alkyl)carbonyl, (cycloalkyl)carbonyl, ((cycloalkyl)alkyl)carbonyl, arylcarbonyl, (aralkyl)carbonyl, (heterocyclo alkyl) carbonyl, ((heterocycloalkyl)alkyl)carbonyl, (heteroaryl)carbonyl, or (heteroaralkyl) carbonyl, each of which being defined herein and being optionally substituted. Examples of amino groups include alkylamino, dialkylamino, or arylamino. When the term "amino" is not the terminal group (e.g., alkylcarbonylamino), it is represented by —$NR^X$–. $R^X$ has the same meaning as defined above.

As used herein, a "cycloalkyl" group refers to a saturated carbocyclic mono- or bicyclic (fused or bridged) ring of 3-10 (e.g., 5-10) carbon atoms. Examples of cycloalkyl groups include cyclopropyl, cyclobutyl, cyclopentyl, cyclohexyl, cycloheptyl, adamantyl, norbornyl, cubyl, octahydroindenyl, decahydro-naphthyl, bicyclo[3.2.1]octyl, bicyclo[2.2.2]octyl, bicyclo[3.3.1]nonyl, bicyclo[3.3.2.]decyl, bicyclo[2.2.2]octyl, adamantyl, or ((aminocarbonyl)cycloalkyl)cycloalkyl.

As used herein, a "heterocycloalkyl" group refers to a 3-10 membered mono- or bicylic (fused or bridged) (e.g., 5- to 10-membered mono- or bicyclic) saturated ring structure, in which one or more of the ring atoms is a heteroatom (e.g., N, O, S, or combinations thereof). Examples of a heterocycloalkyl group include piperidyl, piperazyl, tetrahydropyranyl, tetrahydrofuryl, 1,4-dioxolanyl, 1,4-dithianyl, 1,3-dioxolanyl, oxazolidyl, isoxazolidyl, morpholinyl, thiomorpholyl, octahydrobenzofuryl, octahydrochromenyl, octahydrothio chromenyl, octahydroindolyl, octahydropyrindinyl, decahydroquinolinyl, octahydrobenzo[b] thiophenyl, 2-oxa-bicyclo[2.2.2]octyl, 1-aza-bicyclo[2.2.2]octyl, 3-aza-bicyclo[3.2.1]octyl, and 2,6-dioxa-tricyclo[3.3.1.0] nonyl. A monocyclic heterocycloalkyl group can be fused with a phenyl moiety to form structures, such as tetrahydroisoquinoline, which would be categorized as heteroaryls.

A "heteroaryl" group, as used herein, refers to a monocyclic, bicyclic, or tricyclic ring system having 4 to 15 ring atoms wherein one or more of the ring atoms is a heteroatom (e.g., N, O, S, or combinations thereof) and in which the monocyclic ring system is aromatic or at least one of the rings in the bicyclic or tricyclic ring systems is aromatic. A heteroaryl group includes a benzofused ring system having 2 to 3 rings. For example, a benzofused group includes benzo fused with one or two 4 to 8 membered heterocycloaliphatic moieties (e.g., indolizyl, indolyl, isoindolyl, 3H-indolyl, indolinyl, benzo[b]furyl, benzo[b]thiophenyl, quinolinyl, or isoquinolinyl). Some examples of heteroaryl are pyridyl, 1H-indazolyl, furyl, pyrrolyl, thienyl, thiazolyl, oxazolyl, imidazolyl, tetrazolyl, benzofuryl, isoquinolinyl, benzthiazolyl, xanthene, thioxanthene, phenothiazine, dihydroindole, benzo[1,3]dioxole, benzo[b]furyl, benzo[b] thiophenyl, indazolyl, benzimidazolyl, benzthiazolyl, puryl, cinnolyl, quinolyl, quinazolyl, cinnolyl, phthalazyl, quinazolyl, quinoxalyl, isoquinolyl, 4H-quinolizyl, benzo-1,2,5-thiadiazolyl, or 1,8-naphthyridyl.

Without limitation, monocyclic heteroaryls include furyl, thiophenyl, 2H-pyrrolyl, pyrrolyl, oxazolyl, thazolyl, imidazolyl, pyrazolyl, isoxazolyl, isothiazolyl, 1,3,4-thiadiazolyl, 2H-pyranyl, 4-H-pranyl, pyridyl, pyridazyl, pyrimidyl, pyrazolyl, pyrazyl, or 1,3,5-triazyl. Monocyclic heteroaryls are numbered according to standard chemical nomenclature.

Without limitation, bicyclic heteroaryls include indolizyl, indolyl, isoindolyl, 3H-indolyl, indolinyl, benzo[b]furyl, benzo[b]thiophenyl, quinolinyl, isoquinolinyl, indolizinyl, isoindolyl, indolyl, benzo[b]furyl, bexo[b]thiophenyl, indazolyl, benzimidazyl, benzthiazolyl, purinyl, 4H-quinolizyl, quinolyl, isoquinolyl, cinnolyl, phthalazyl, quinazolyl, quinoxalyl, 1,8-naphthyridyl, or pteridyl. Bicyclic heteroaryls are numbered according to standard chemical nomenclature.

As used herein, the term "treat rate" refers to the weight percent of a component in the lubricating and cooling fluids.

The weight average molecular weight (Mw) and the number average molecular weight (Mn) may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available poly(methyl methacrylate) (PMMA) standards having a narrow molecular weight distribution ranging from 960-1,568,000 g/mol. The calibration curve can be extrapolated for samples having a mass less than 500 g/mol. Samples and PMMA standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

EXAMPLES

A better understanding of the present disclosure and its many advantages may be clarified with the following examples. The following examples are illustrative and not limiting thereof in either scope or spirit. Those skilled in the art will readily understand that variations of the components, methods, steps, and devices described in these examples can be used. Unless noted otherwise or apparent from the context of discussion in the Examples below and throughout this disclosure, all percentages, ratios, and parts noted in this disclosure are by weight.

Example 1

Blend studies of lubricants with polymethacrylate (PMA) polymers were evaluated for suitability for use in motorcycles. The lubricants evaluated for this study included one of three different polymeric additives and the same additive package in an API Group III base oil. High temperature high shear viscosity was measured pursuant to JASO T 903:2016. The polymers of this evaluation included: PMA 1 having a weight average molecular weight of about 510,000, PMA 2 having a weight average molecular weight of about 290,000, or PMA 3 having a weight average molecular weight of about 420,000.

A lubricant with about 7 weight percent of PMA 1 had a KV100 of about 10.0 cSt, a HTHS viscosity of about 2.86 cSt, and a viscosity index of about 316 and was not suitable for a motorcycle lubricant. A lubricant with about 14 weight percent of PMA 2 had a KV100 of about 8.5 cSt, a HTHS viscosity of about 3.0 cSt, and a viscosity index of about 296 and was suitable for a motorcycle lubricant. A lubricant with about 19 percent of PMA 3 had a KV100 of about 8.5 cSt, a HTHS viscosity of about 3.2 cSt, and a viscosity index of about 288 and was also suitable for a motorcycle lubricant. Viscosity index was determined pursuant to ASTM D2270.

Example 2

Motorcycle lubricants were evaluated for improvement in fuel economy as compared to a 10W-30 baseline lubricant. For this Example, the motorcycle was a 125 cc scooter and the baseline lubricant was Honda Ultra E1 10W-30 including MoDTC and having a KV100 of 10.4 cSt, a KV40 of 66.0 cSt, a HTHS viscosity at 150 C of 3.1 cP, a viscosity index of about 145, and a wet clutch rating of MB. The lubricants of Table 5 included the noted polymeric additives and all fluids included the same additive package and amounts of dispersants, detergents, pour point depressants, antiwear additives, antioxidants, friction modifiers, and an API Group III base oil. High temperature high shear viscosity and wet clutch rating were measured pursuant to JASO T 903:2016 and fuel economy was measured using the World Motorcycle Test Cycle (WMTC) at the Japan Automobile Transport Technology Association (or other industry emission test houses). The PMA used in this Example was PMA 2 from Example 1. The OCP had a weight average molecular weight of about 155,000.

TABLE 5

| Sample | A | B | C | D |
|---|---|---|---|---|
| Viscosity Grade | 0 W-20 | | | |
| Polymer, wt % | PMA 2 | | OCP | |
| | 14.4 | 14.4 | 8.0 | 8.0 |
| MoDTC, wt % | — | 0.5 | — | 0.5 |
| KV100, cSt | 8.23 | 8.3 | 8.43 | 8.46 |
| KV40, cSt | 27.45 | 27.64 | 42.48 | 42.81 |
| HTHS150, cP | 2.96 | 2.98 | 2.66 | 2.65 |
| Wet Clutch rating | MA | MB | MA | MB |
| Viscosity Index | 302 | 303 | 179 | 179 |
| Fuel Economy Gain (%) | +1.3% | +1.7% | +1.4% | +1.8% |

As shown in Table 5, the lubricants all had improved fuel economy as compared to the baseline lubricant even with a higher viscosity index than the baseline, and had passing wet clutch ratings and passing HTHS viscosity or HTHS viscosity within 20 percent of the baseline fluids. Clutch testing was using a SAE #2 test rig in accordance with JASO T903:2106 standards, and fuel consumption was evaluated using the WMTC cycle with a Class-1 motorcycle. Improvement in fuel economy was the average of multiple test runs as compared to the 10W-30 baseline (twice for cold mode and six times for hot mode). Viscosity index was determined pursuant to ASTM D2270.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method of improving the fuel economy of a motorcycle using a lubricating oil composition, the method comprising:

lubricating an engine crankcase and a transmission including a wet clutch of the motorcycle with a lubricating oil composition from a common sump;

the lubricating oil composition having a viscosity grade selected from 0W-20, 0W-16, 0W-12, or 0W-8 and including (a) at least one base oil of lubricating viscosity; (b) about 14 to about 20 weight percent of a linear non-dispersant poly(meth)acrylate copolymer viscosity modifier having a weight average molecular weight of about 200,000 to about 300,000 and includes (meth)acrylate monomer units with hydrocarbyl groups in a monomer ester moiety thereof having a weight average molecular weight of about 400 up to about 700; (c) optionally a molybdenum dialkyl dithiocarbamate; and (d) a dispersant, a detergent, a pour point depressant, an antiwear additive, an antioxidant, and a friction modifier;

wherein the lubricating oil composition has a high-temperature high shear (HTHS) viscosity at 150° C. of 2.9 cP to 3.2 cP and a clutch friction rating of MA, MA1, MA2, or MB when measured pursuant to JASO T 903:2016;

wherein the fuel economy of the motorcycle is improved as measured pursuant to a WMTC cycle of at least 1 percent better than the fuel economy as measured on the motorcycle using the WMTC cycle when the motorcycle is lubricated with a higher viscosity grade 10W-30 lubricant; and wherein the lubricating oil composition has a viscosity index of 250 to 350, a KV100 of less than 10 cP, and a ratio of the viscosity index to the treat rate of the linear non-dispersant poly(meth)acrylate copolymer viscosity modifier of about 15 to about 21.

2. The method of claim 1, wherein the linear non-dispersant poly(meth)acrylate copolymer viscosity modifier has a polydispersity index of about 1.5 to about 2.5.

3. The method of claim 1, wherein the lubricating oil composition is devoid of the molybdenum dialkyl dithiocarbamate.

4. The method of claim 1, wherein the lubricating oil composition includes about 800 ppm or less of molybdenum provided from the molybdenum dialkyl dithiocarbamate.

5. The method of claim 1, wherein the motorcycle has an engine capacity of 150 $cm^3$ or less.

6. A method of lubricating a crankcase and a wet clutch of a motorcycle, the method comprising:

lubricating an engine crankcase and a transmission including a wet clutch of the motorcycle with a lubricating oil composition from a common sump;

the lubricating oil composition having (a) a viscosity grade selected from 0W-20, 0W-16, 0W-12, or 0W-8 and a KV100 of less than 10cP; (b) about 14 to about 20 weight percent of a polymeric viscosity modifier selected from a linear non-dispersant poly(meth)acrylate copolymer, wherein the polymeric viscosity modifier has a weight average molecular weight of about 200,000 to about 300,000 and includes (meth)acrylate monomer units with hydrocarbyl groups in a monomer ester moiety thereof having a weight average molecular weight of about 400 up to about 700; (c) optionally including about 800 ppm or less of molybdenum provided from a molybdenum dialkyl dithiocarbamate friction modifier; (d) a dispersant, a detergent, a pour point depressant, an antiwear additive, an antioxidant, and a friction modifier; and (e) a viscosity index of 250 to 350 and wherein a ratio of the viscosity index to the treat rate of the linear non-dispersant poly(meth)acrylate copolymer viscosity modifier is about 15 to about 21;

the lubricating oil composition exhibits (i) a clutch friction rating of MA, MA1, MA2, or MB when measured pursuant to JASO T 903:2016 and (ii) a high temperature high shear (HTHS) viscosity at 150° C. pursuant to JASO T 903:2016 within about 20 percent of a HTHS viscosity of a 10W-30 lubricant and between 2.9 cP to 3.2 cP; and wherein the motorcycle lubricated with the lubricating oil composition has a fuel economy measured pursuant to the WMTC cycle of at least 1 percent better than the fuel economy measured on the motorcycle when lubricated with a higher viscosity grade 10W-30 lubricant.

7. The method of claim 6, wherein the motorcycle has an engine capacity of 150 $cm^3$ or less.

* * * * *